US005611325A

United States Patent [19]

Kudlacek

[11] Patent Number: 5,611,325

[45] Date of Patent: Mar. 18, 1997

[54] ARCHERY BOW STABILIZER

[76] Inventor: Donald S. Kudlacek, 3412 Oak St., Longview, Wash. 98632

[21] Appl. No.: 622,966

[22] Filed: Mar. 27, 1996

[51] Int. Cl.[6] ..... F41B 5/20

[52] U.S. Cl. ..... 124/89

[58] Field of Search ..... 124/86, 88, 89; 411/393

[56] References Cited

U.S. PATENT DOCUMENTS

| | | | |
|---|---|---|---|
| 1,107,177 | 8/1914 | Noble | 411/393 X |
| 3,501,993 | 3/1970 | Swenson | 411/393 |
| 3,645,161 | 2/1972 | Wesker | 411/393 |
| 4,135,486 | 1/1979 | Enomoto | 124/89 |
| 4,478,204 | 10/1984 | Kocsan | 124/89 |
| 5,090,396 | 2/1992 | Bickel et al. | 124/89 |

FOREIGN PATENT DOCUMENTS

| | | | |
|---|---|---|---|
| 1062372 | 3/1967 | United Kingdom | 411/393 |

*Primary Examiner*—John A. Ricci

*Attorney, Agent, or Firm*—Olson & Olson

[57] ABSTRACT

An archery bow stabilizer is formed of at least three elongated stabilizer rods secured at their inner ends to a base member mounted detachably on the handle of an archery bow and extending forwardly of the bow handle in parallel, circumferentially spaced-apart arrangement. At least one tuning slide member has elongated openings therethrough, spaced apart to match the spacing of the stabilizer rods and having a larger diameter than the rods for freely receiving the rods therethrough. A set screw is threaded into a threaded bore in the tuning slide member, the bore communicating with each opening, and a resilient pad on the inner end of the set screw is arranged to engage the associated stabilizer rod to secure the turning slide member to the stabilizer rods intermediate the ends of the rods, the pads allowing the rods to vibrate in the enlarged openings. The outer ends of the stabilizer rods are spaced apart freely from each other for individual vibration, and preferably are fitted with enlarged diameter weights to retard vibration. An O-ring cushion on each weight provides a resilient bumper for cushioning the stabilizer rods from each other during vibration.

6 Claims, 1 Drawing Sheet

ARCHERY BOW STABILIZER

BACKGROUND OF THE INVENTION

This invention relates to archery bows, and more particularly to a novel stabilizer for archery bows.

Many forms of stabilizers presently are in use or proposed for use on archery bows. Typical of these is the spring loaded stabilizer disclosed in U.S. Pat. No. 4,660,538; the fixed mass stabilizer disclosed in U.S. Pat. No. 4,955,356; and the movable fluid stabilizer disclosed in U.S. Pat. No. 4,570,608. All of these types of stabilizers have limited stabilizing effectiveness.

More pertinent to this invention is the adjustable archery stabilizer disclosed in U.S. Pat. No. 5,090,396. This stabilizer includes three elongated, parallel rods with two end caps rigidly capturing and interconnecting the rods. One of the end caps secures the rod assembly to an archery bow. A tuning slider is mounted on the rods for axial adjustment for tuning the rod assembly for dampening vibrations generated when an arrow is shot from the bow. The fixed end cap at the outer end of the rod assembly limits the range of vibration dampening.

SUMMARY OF THE INVENTION

This invention provides an archery bow stabilizer comprised of a plurality of elongated, parallel rods secured at one end to a base configured for attachment to an archery bow handle, at least one vibration adjuster intermediate the ends of the rods, the rods extending through enlarged openings in the vibration adjuster, and resilient securing means on the vibration adjuster extending adjustably into the enlarged openings and engaging the associated rods, for securing the vibration adjuster to the rods and allowing the rods to vibrate in the enlarged openings.

It is the principal objective of this invention to provide an archery bow stabilizer that overcomes the aforementioned limitations and disadvantages of prior stabilizers.

Another objective of this invention is the provision of an archery bow stabilizer of the class described that provides a degree of vibration stabilization not attainable heretofore.

Still another object of this invention is to provide an archery bow stabilizer of the class described in which the free ends of the rods are spaced resiliently from each other to allow each rod to vibrate independently of the others.

A further objective of this invention is the provision of an archery bow stabilizer of the class described that is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
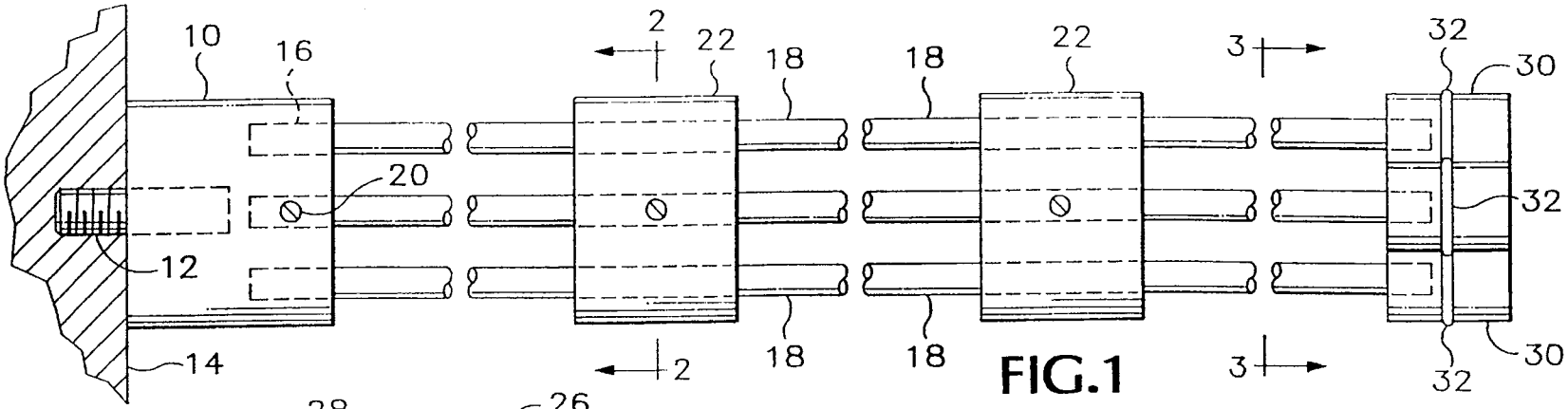
FIG. 1 is a foreshortened side elevation of an archery bow stabilizer embodying the features of this invention.
Figure 3:
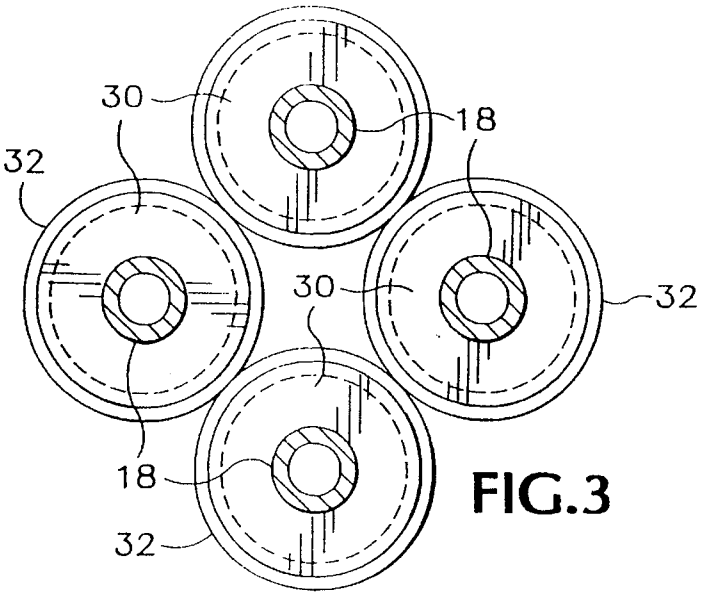
FIG. 3 is a cross sectional view, on an enlarged scale, taken on the line 3—3 in FIG. 1.
Figure 2:
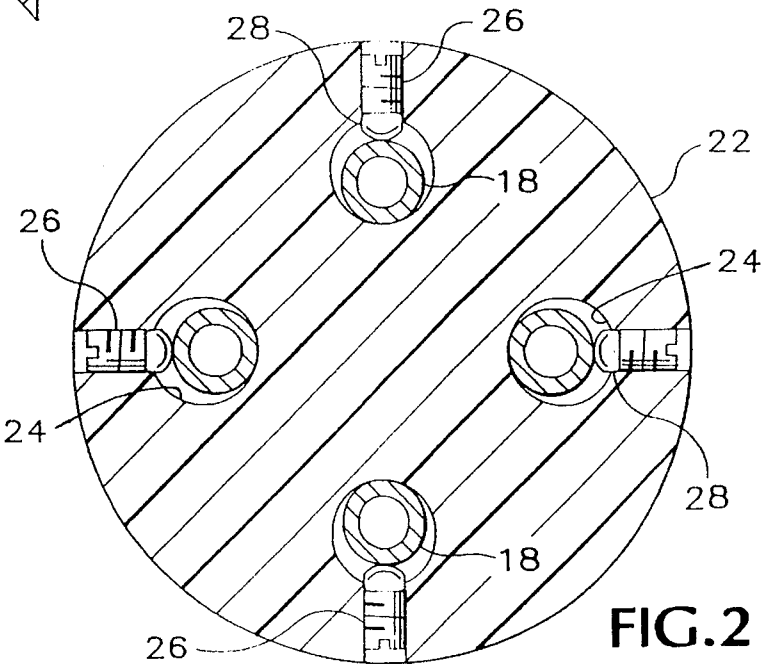
FIG. 2 is a cross sectional view, on an enlarged scale, taken on the line 2—2 in FIG. 1.

The archery bow stabilizer illustrated in the drawings includes a base member 10 provided with a threaded stud 12 projecting from its rearward end and configured for threaded connection to the front face of an archery bow handle 14. The forward end of the base member is provided with a plurality of bores 16 for the reception of the rearward ends of a corresponding plurality of elongated stabilizer rods 18. In the embodiment illustrated, there are four such stabilizer rods spaced apart at 90 intervals about the axial centerline of the base member. Any other desired number of rods may be used, the minimum number being three. The rods preferably are made of carbon filament material. Set screws 20 secure the rods to the base member.

Intermediate the ends of the elongated stabilizer rods there are slidably mounted at least one, and preferably a plurality of tuning slide members 22. Each member 22 is provided with a plurality of through bores 24 matching the number of stabilizer rods and arranged on the same circumferential spacing pattern as the bores 16 in the base member 10. The bores 24 are slightly larger in diameter than the rods 18 to allow vibrational movement of the rods. A set screw 26 is mounted in each tuning member 22 in registry with each through bore 24, and a resilient pad 28 is mounted on the inner end of each set screw for releasably engaging the associated stabilizer rod 18. It is by this provision of the set screws 26 and pads 28 that each tuning slide member 22 may be released from the stabilizer rods 18 and slid along the length of said rods to selected positions which maximize the dampening of vibrations in a variety of archery bows as an arrow is shot from the bow. The set screws with pads then are tightened against the rods to secure the tuning slide members in their selected positions.

Because of the enlarged bores 24 in the tuning slide members 22, the outer ends of the stabilizer rods are free to move or otherwise vibrate independently of each other. Each preferably is fitted with an enlarged weight member 30 which is secured thereto as by welding. A resilient O-ring 32 preferably encircles each weight member, intermediate the ends thereof, to provide cushioning between the weight members during vibration of the rods.

It has been determined that significant improvement in vibration dampening of an archery bow is achieved by the freedom of movement of the outer ends of the stabilizer rods 18, as distinguished from the degree of dampening when the outer ends of the rods are captured rigidly in the same manner as the inner ends of the rods are anchored in base member 10. Adjustment of the tuning slide members 22 along the stabilizer rods 18 and securing them in the enlarged bores 24 by the set screws 26 with resilient pads 28, achieves precise tuning of the archery bow, as demonstrated by tighter grouping of arrows in a target, as compared with stabilizers of the prior art. Freedom of movement of the stabilizer rods in the enlarged bores 24 and at the unrestrained outer weighted ends 30, permitted by the resilient pads 28, results in the absorption of greater vibration energy, with corresponding greater reduction in vibration of the archery bow.

It will be apparent to those skilled in the art that various changes may be made in the size, shape, type, number and arrangement of parts described hereinbefore. For example, the outer end portions of the hollow rods 18 may be filled with lead or other weight material, in place of the enlarged heads 30. Other changes may be made, as desired, without departing from the spirit of this invention and the scope of the appended claims.

I claim:

1. An archery bow stabilizer, comprising:

a) a base member configured for attachment to an archery bow handle, b) at least three elongated stabilizer rods each having an inner end and an outer end, c) anchor means on the base member securing the inner ends of the stabilizer rods thereto with the rods extending forwardly therefrom substantially parallel to and spaced apart circumferentially from each other, d) at least one vibration dampener adjustment member having openings therethrough matching the number and circumferential spacing of said stabilizer rods and a diameter larger than the diameter of said stabilizer rods freely receiving said rods therethrough, and e) resilient securing means on the vibration dampener adjustment member extending into each of said openings and resiliently engaging and securing said adjustment member to said stabilizer rods intermediate the inner and outer ends of said rods.

2. The archery bow stabilizer of claim 1 wherein the resilient securing means comprises a set screw adjustably engaging a threaded bore in the adjustment member and communicating with each opening in the adjustment member, and a resilient pad on the inner end of the set screw configured for releasable engagement with the stabilizer rod.

3. The archery bow stabilizer of claim 1 including resilient cushioning means adjacent the outer ends of the stabilizer rods for cushioning said stabilizer rods from each other during vibration thereof.

4. The archery bow stabilizer of claim 1 including weight means on the outer ends of the stabilizer rods.

5. The archery bow stabilizer of claim 4 including resilient cushioning means on the weight means for cushioning said stabilizer rods from each other during vibration thereof.

6. An archery bow stabilizer, comprising:

a) a base member configured for attachment to an archery bow handle, b) at least three elongated stabilizer rods each having an inner end and an outer end, c) anchor means on the base member securing the inner ends of the stabilizer rods thereto with the rods extending forwardly therefrom substantially parallel to and spaced apart circumferentially from each other, d) at least one vibration dampener adjustment member having openings therethrough matching the number and circumferential spacing of said stabilizer rods and a diameter larger than the diameter of said stabilizer rods freely receiving said rods therethrough, a set screw adjustably engaging a threaded bore in the adjustment member communicating with each opening in the adjustment member, and a resilient pad on the inner end of the set screw configured for releasable engagement with the stabilizer rod, f) weight means on the outer ends of the stabilizer rods, and g) resilient cushioning means on the weight means for cushioning said stabilizer rods from each other during vibration thereof.

* * * * *